US005673741A

United States Patent [19]

Cairns

[11] Patent Number: 5,673,741

[45] Date of Patent: Oct. 7, 1997

[54] CURTAIN ROD WITH ATTACHMENT SURFACES

[76] Inventor: Janice E. Cairns, 730 Helga Dr., Woodstock, Ga. 30188

[21] Appl. No.: 595,412

[22] Filed: Feb. 5, 1996

[51] Int. Cl.[6] ..... A47H 1/00

[52] U.S. Cl. ..... 160/330; 160/39; 160/368.1; 248/265

[58] Field of Search ..... 160/38, 39, 19, 160/368.1, 330; 248/265

[56] References Cited

U.S. PATENT DOCUMENTS

| | | | |
|---|---|---|---|
| 2,681,697 | 6/1954 | Mandella | 160/19 |
| 3,433,281 | 3/1969 | Lukashok | 160/330 |
| 3,437,127 | 4/1969 | Lukashok | 160/330 |
| 3,561,714 | 2/1971 | Zurawski | 160/19 X |
| 3,996,987 | 12/1976 | Rodriguez | 160/330 X |
| 4,235,406 | 11/1980 | Vecchiarelli . | |
| 4,662,596 | 5/1987 | Haarer . | |
| 4,991,640 | 2/1991 | Verkindt et al. | 160/368.1 |
| 5,033,525 | 7/1991 | Paeselt | 160/19 X |
| 5,039,049 | 8/1991 | Niemi | 160/39 X |
| 5,042,548 | 8/1991 | Attal | 160/38 |
| 5,063,985 | 11/1991 | Bozzo | 160/330 |
| 5,067,542 | 11/1991 | Easley | 160/330 X |
| 5,074,348 | 12/1991 | Phillips | 160/38 |
| 5,090,095 | 2/1992 | Lightfoot . | |
| 5,094,006 | 3/1992 | Varney . | |
| 5,259,687 | 11/1993 | John | 160/38 X |
| 5,316,067 | 5/1994 | LeClaire . | |
| 5,330,821 | 7/1994 | Lo | 160/39 X |
| 5,335,709 | 8/1994 | Borzi | 160/39 |
| 5,484,006 | 1/1996 | Walker | 160/38 |
| 5,503,209 | 4/1996 | Healzer | 160/38 |
| 5,520,234 | 5/1996 | Simmons | 160/38 |
| 5,570,490 | 11/1996 | Walsh et al. | 160/330 X |
| 5,597,025 | 1/1997 | Forkner | 160/368.1 X |

FOREIGN PATENT DOCUMENTS

| | | |
|---|---|---|
| 2 617 700 | of 1987 | France . |
| 2 114 875 | 9/1983 | United Kingdom . |

OTHER PUBLICATIONS

Four Photographs of a metal curtain rod that is believed to have been on sale in the country more than one year prior to the application date of the present patent application.

*Primary Examiner*—Brian K. Green
*Assistant Examiner*—Bruce A Lev
*Attorney, Agent, or Firm*—Jones & Askew

[57] ABSTRACT

A telescoping curtain rod and associated draperies that have attachment surfaces such as two-piece hook-and-loop fasteners commonly referred to as a VELCRO fasteners. The curtain rod includes an outer frame, an inner frame slidably mounted within the outer frame, and first and second brackets for attaching the curtain rod to a vertical support surface such as a wall. The outer and inner frames may each include front and top sides carrying attachment surfaces. The top and front sides of the inner frame may have indentations for carrying the attachment surfaces so as to allow the inner frame to slide easily within the outer frame. The top sides of the outer and inner frames may include tabs for engaging the brackets so as to maintain the top sides of the outer and inner frames substantially perpendicular to the vertical support surface. Multi-piece window treatments can therefore be easily installed and removed. Drapery hooks, drapery pockets, and custom made drapery boards are not required to construct window treatments.

21 Claims, 5 Drawing Sheets

CURTAIN ROD WITH ATTACHMENT SURFACES

TECHNICAL FIELD

The present invention relates generally to window treatments, and more particularly relates to an improved curtain rod with attachment surfaces for removably attaching draperies thereto.

BACKGROUND OF THE INVENTION

High quality window treatments, a hallmark of a well decorated home, are usually custom made. A window treatment may include several separate draperies. For example, custom made window treatments often include draperies in left-hand and right-hand pairs. In addition, overdraperies may hang in front of sheers or liners. A custom made window treatment may also include a movable curtain in conjunction with a top treatment such as a valance, cornice, or lambrequin. A swag or balloon valance may hang between the left-hand and right-hand draperies. Many options are available when designing a custom made window treatment. A home owner may select various combinations of draperies, blinds and awnings in a wide variety of fabrics, styles, cuts, and colors to suit his or her personal taste.

Many types of curtain rods and mechanisms for attaching draperies to curtain rods have been employed. A conventional "pocket" type curtain rod is inserted through a pocket or channel sewn into the drapery. The curtain rod carrying the pocket type drapery is then snapped or clipped onto a pair of brackets that are used to attach the curtain rod to a wall or window frame. Such a pocket type drapery can be easily gathered into bunches that resemble pleats. In some cases, upper and lower curtain rods are used to support a single drapery having upper and lower pockets. Such a drapery may be tied in the middle to form an hourglass drapery.

A different type of curtain rod is often used for a draw type curtain that is typically opened and closed by way of a draw string. A draw type curtain rod includes movable eyes that allow a pair of draperies forming a curtain to be attached to the rod. In such a draw type curtain, a plurality of drapery hooks are typically used to attach each drapery to the eyes on the curtain rod. One end of each drapery is anchored to one end of the curtain rod and the other end of each drapery is attached to a master carrier that moves within the curtain rod.

A draw type curtain is often combined with one or more pocket type draperies in a single window treatment. Adjustable brackets are available that allow the distance between a curtain rod and the wall supporting the curtain rod to be varied. Such adjustable brackets allow several curtain rods to be layered in a single window treatment. For example, a single window treatment may include a pocket type overdrapery assembly carded on a first curtain rod, and a movable curtain carried on a second curtain rod. The pocket type overdrapery assembly might including a left-hand and right-hand pair of fled-back draperies and a swag valance. A different type of window treatment might include a movable pair of overdraperies carded on a first curtain rod, and a pocket type sheer drapery carded on a second curtain rod.

The conventional window treatments described above are generally difficult to install and, once installed, difficult to remove. As noted above, movable-type curtain rods use drapery hooks to attach a drapery to the rod. These drapery hooks are typically sharp and difficult to insert into the stiff heading of a typical drapery. It is easy to stab a finger or tear the backing material on a drapery heading.

Removing and re-installing such a drapery is usually a frustrating and sometimes painful experience because the drapery hooks tend to fall out when the draperies are not attached to the curtain rod. A drapery hook may then be lost, only to turn up in an unfortunate location such as a sofa cushion. Pocket type draperies can also be difficult to install and remove. When inserting a curtain rod through a drapery pocket, the end of the curtain rod may snag on the drapery fabric, particularly at the seams between drapery panels. A drapery made of a sheer material can run or split when snagged.

The difficulty in installing and removing conventional window treatments leads to several inherent disadvantages. First, the typical do-it-yourself home decorator cannot handle, or does not go the trouble of tackling, elaborate multi-piece window treatments. Second, cleaning and other maintenance is typically performed in the home with the drapery remaining in place. Therefore, it is difficult and expensive to clean such a drapery properly. Third, the draperies cannot be changed from time-to-time, for example, with the seasons or as part of a general redecorating effort. A custom made window treatment can therefore be a type of albatross for the typical home owner.

Other conventional window treatments include wooden cornices or valances to which drapery fabric is attached. For example, Varney, U.S. Pat. No. 5,094,006, describes a fabric swag made using a template. The swag is attached to a drapery board using hooks, studs, tacks, gimps or staples at positions spaced along the board. Preferably, the fabric is attached to the board using a strip of hook-and-loop fastener material (i.e., a VELCRO fastener) extending along the length of the drapery board. The swag described by Varney is cut using a special template that allows the swag to be installed and removed with a minimum of skill or experience.

Smith, U.K. Patent Application No. 2,225,232 describes a window treatment including a left-hand and right-hand pair of tail draperies and an intermediate swag drapery. A strip of hook-and-loop fastener is attached to the rear side of each drapery near the top edge of the drapery. The hook-and-loop fasteners allow each drapery to be removably attached to a wooden drapery board that carries a mating strip of hook and loop fastener. In addition, a second strip of hook-and-loop fastener is attached to the front side of each drapery. Draperies can thus be layered on the drapery board. A decorative coveting strip covers the exposed hook-and-loop fasteners on the front sides of the outer most draperies.

Although Varney and Smith describe draperies that can be installed and removed easily, they does not describe an entire window treatment that can be installed and removed with a minimum of skill or experience. In particular, a window treatment constructed according to the teaching of Varney or Smith requires that draperies be attached to a wooden drapery board. Such a drapery board is typically the top side or front side of a cornice or valance that is constructed to fit the dimensions of the window to be decorated.

A custom made cornice or valance typically includes several pieces of wood that are assembled much like a wooden cabinet. Hook-and-loop fasteners are then attached to predetermined positions on the drapery and the drapery board. The cornice or valance is then affixed to the wall and the drapery is installed. Varney and Smith only describe the construction of draperies. It takes a significant amount of time and skill to construct and install a custom made cornice or valance. Moreover, a window treatment including a custom made cornice or valance is generally considered to be a permanent fixture.

The improved window treatments described Varney and Smith are generally expensive and rather difficult to install and remove because a cornice or valance must be custom made for each application. Therefore, it is difficult and, in many cases, impossible or impractical to relocate a custom made window treatment constructed according to the teaching of Varney and Smith. Of course, a custom made window treatment is typically designed to match a home owner's taste and furnishings. When it is time for the home owner to move, it would be advantageous if such a window treatment could be moved to the owner's next home.

Thus, there is a need for a multi-piece window treatment that can be easily installed and removed.

There is a further need for an adjustable curtain rod that supports a multi-piece window treatment that can be easily installed and removed.

There is a further need for window treatments that can be easily adapted to different locations.

There is a further need for draperies that can be installed without the use of drapery hooks, drapery pockets, or custom made drapery boards.

There is a further need for draperies that can be easily removed for cleaning and redecorating.

SUMMARY OF THE INVENTION

The present invention meets the above-described needs by providing a telescoping curtain rod having at least one attachment surface. The term "attachment surface" is used herein to refer to a permanent or semi-permanent surface capable of supporting items attached thereto such as a hook-and-loop fastener, snaps, buttons, and the like. Draperies having mating attachment surfaces can therefore be easily attached to and removed from the curtain rod. Multi-piece window treatments can therefore be easily installed and removed. Drapery hooks, drapery pockets, and custom made drapery boards are not required to construct window treatments according to the present invention.

Generally described, the present invention provides a curtain rod including an elongated outer frame and an elongated inner frame slidably mounted within the outer frame. The inner and the outer frame each include one or more attachment surfaces for removably attaching a drapery thereto. The said outer frame includes means for receiving a first bracket, and the inner frame includes means for receiving a second bracket.

More specifically described, the present invention provides a curtain rod including an elongated outer frame having a front side carrying a first attachment surface for removably attaching a drapery thereto, and an elongated inner frame slidably mounted within the outer frame, the inner frame also having a front side carrying a second attachment surface for removably attaching a drapery thereto.

Alternatively, the curtain rod may include an elongated outer frame having a top side carrying a first attachment surface for removably attaching a drapery thereto, and an elongated inner frame slidably mounted within the outer frame, the inner frame having a top side carrying a second attachment surface for removably attaching a drapery thereto. The inner frame may have indentations in which the second attachment surface is carried.

Either embodiment of the curtain rod also includes a first bracket attachable to a vertical support surface and attachable to the outer frame, and a second bracket attachable to the vertical support surface and attachable to the inner frame.

According to another aspect of the present invention, a curtain rod is provided having an elongated outer frame with a front side carrying a first attachment surface, and an elongated inner frame with a front side carrying a second attachment surface. The outer frame includes a top side carrying a third attachment surface, and the inner frame includes a top side carrying a fourth attachment surface. The front and top sides of the inner frame may have indentations in which the second and fourth attachment surfaces are carried, respectively.

According to another aspect of the present invention, the top side of the outer frame may define a first tab for engaging the first bracket so as to maintain the top side of the outer frame substantially perpendicular to the vertical support surface. Similarly, the top side of the inner frame may define a second tab for engaging the second bracket so as to maintain the top side of the inner frame substantially perpendicular to the vertical support surface.

The present invention also provides a window treatment including a curtain rod having an outer frame with a front side carrying a first attachment surface for removably attaching a drapery thereto, and an inner frame slidably mounted within the outer frame, the inner frame having a front side carrying a second attachment surface for removably attaching a drapery thereto.

Alternatively, the curtain rod may include an outer frame having a top side carrying a first attachment surface for removably attaching a drapery thereto, and an inner frame slidably mounted within the outer frame, the inner frame having a top side carrying a second attachment surface for removably attaching a drapery thereto. The window treatment also includes a first drapery removably attached to the first attachment surface, and a second drapery removably attached to the second attachment surface.

According to another aspect of the present invention, a window treatment is provided including a curtain rod having an outer frame with a front side carrying a first attachment surface, and an inner frame with a front side carrying a second attachment surface. The outer frame includes a top side carrying a third attachment surface, and the inner frame includes a top side carrying a fourth attachment surface. The window treatment also includes a first drapery removably attached to the first attachment surface, and a second drapery removably attached to the first attachment surface. The window treatment may also include a third drapery removably attached to at least one attachment surface.

According to another aspect of the present invention, the top side of the outer frame of the curtain rod may define a first tab for engaging the first bracket so as to maintain the top side of the outer frame substantially perpendicular to the vertical support surface. Similarly, the top side of the inner frame of the curtain rod may define a second tab for engaging the second bracket so as to maintain the top side of the inner frame substantially perpendicular to the vertical support surface.

Described with more particularity, the present invention provides a curtain rod including an elongated outer frame formed of a thin, flat, rigid material. The outer frame defines a front side carrying a first attachment surface extending substantially less than the height and substantially all of the length of the front side of the outer frame. The outer frame also defines a top side carrying a second attachment surface extending substantially less than the height and substantially all of the length of the top side of the outer frame. The top side of the outer frame is substantially perpendicular to the front side of the outer frame, and defines a first tab.

A curtain rod according to the present invention also includes an elongated inner frame formed of a thin, flat, rigid material. The inner frame is slidably mounted within the outer frame. The inner frame defines a front side carrying a third attachment surface extending substantially less than the height and substantially all of the length of the front side of the inner frame. The inner frame also defines a top side carrying a fourth attachment surface extending substantially less than the height and substantially all of the length of the top side of the inner frame. The top side of the inner frame is substantially perpendicular to the front side of the inner frame, and defines a second tab.

A curtain rod according to the present invention also includes means for attaching the outer frame to a first bracket that is attachable to a vertical support surface and attachable to the outer frame. The first bracket engages the first tab so as to maintain the top side of the outer frame substantially perpendicular to the vertical support surface. The curtain also includes means for attaching the inner frame to a second bracket that is attachable to the vertical support surface. The second bracket engages the second tab so as to maintain the top side of the inner frame substantially perpendicular to the vertical support surface.

Each attachment surfaces described above may include one piece of a two-piece hook-and-loop fastener. In addition, the means for attaching a frame to a bracket may include hole through the frame for receiving a spring clip connected to the bracket.

Therefore, it is an object of the present invention to provide a multi-piece window treatment that can be easily installed and removed.

It is a further object of the present invention to provide an adjustable curtain rod that supports a multi-piece window treatment that can be easily installed and removed.

It is a further object of the present invention to provide window treatments that can be easily adapted to different locations.

It is a further object of the present invention to provide draperies that can be installed without the use of drapery hooks, drapery pockets, or custom made drapery boards.

It is a further object of the present invention to provide draperies that can be easily removed for cleaning and redecorating.

That the present invention improves over the drawbacks of the prior art and accomplishes the objects of the invention will become apparent from the detailed description of the preferred embodiment to follow.

DETAILED DESCRIPTION

Figure 1:
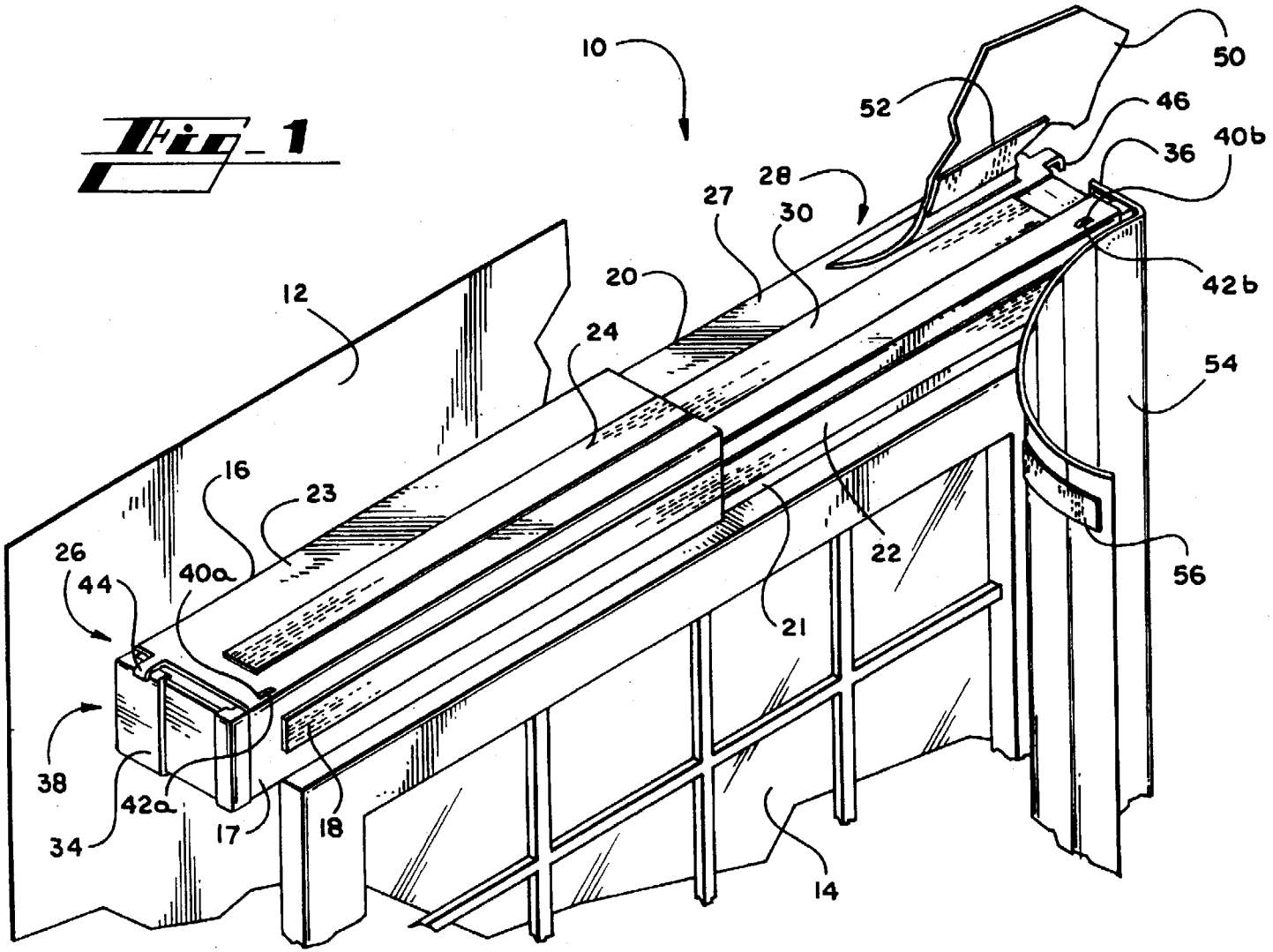
FIG. 1 is a perspective view of a telescoping curtain rod with attachment surfaces.

Referring now to the drawings, in which like numerals indicate like elements throughout the several figures, FIG. 1 is a perspective view of a telescoping curtain rod 10 constructed in accordance with the preferred embodiment of the present invention. The curtain rod 10 is attached to a vertical support surface such as a wall 12. The curtain rod 10 is generally used to support one or more draperies forming a window treatment, and is therefore shown in FIG. 1 above a window 14.

The preferred curtain rod 10 includes an outer frame 16 having a front side 17 carrying a first attachment surface 18 for attaching a drapery thereto. The curtain rod 10 also includes an inner frame 20 having a front side 21 carrying a second attachment surface 22 for attaching a drapery thereto. The inner frame 20 is preferably slidably mounted within the outer frame 16 forming a telescoping curtain rod 10 that is extendable from approximately 26 to 52 inches.

As shown in FIG. 1, the outer frame 16 of the curtain rod 10 also includes a top side 23 carrying a third attachment surface 24 for attaching a drapery thereto. The outer frame 16 also includes a rear side 26 that extends approximately one half inches downward perpendicular from the top side 23 of the outer frame 16. The additional bend in the outer frame 16 form to create the rear side 26 provides the outer frame 16 with increased rigidity and strength.

Similarly, the inner frame 20 includes a top side 27 carrying a fourth attachment surface 30. The inner frame also includes a rear side (shown in FIG. 3) that extends approximately one half inch downward perpendicular to the top side 23 of the inner frame 20. The additional bend in the inner frame 20 form to create the rear side 28 provides the inner frame 20 with increased rigidity and strength.

The curtain rod 10 includes a first bracket 34 that attaches to the vertical support surface 12 and to the outer frame 16, and a second bracket 36 that attaches to the support surface 12 and to the inner frame 20. The brackets 34 and 36 preferably attach to the vertical support surface 12 by way of screws indicated generally at 38. The brackets 34 and 36 preferably attach to the curtain rod 10 by way of spring activated clips. A projection **40*a*** that is part of such a spring activated clip is shown in FIG. 1.

More specifically, the first bracket 34 has a spring activated clip that urges the projection **40*a* of the clip through a hole 42*a* in the outer frame 16. A similar projection 40*b* is urged through an opposing hole 42*b* through a channel 58 formed at the bottom of the top side 17 of the outer frame 16, as shown on FIG. 2C which is described in greater detail below. The bracket 34 thus easily clips into the outer frame 16. The brackets 34 and 36** are preferably interchangeable with the bracket that are manufactured by Cooper Industries of Sturgis, Mich. and marketed under the name "Kirsh."

The top side 17 of the outer frame 16 defines a tab 44 that engages the first bracket 34 so as to support the top side 17 of the inner frame 16 in a position substantially perpendicular to the vertical support surface 12. The tab 44 is located near the rear side 26 of the outer frame 16. The tab 44 is located near the rear side 28 of the inner frame 16. A similar tab 46 for engaging the second bracket 36 is defined by the top side 27 of the inner frame 20.

The attachment surfaces described above are each preferably one piece of a two piece hook-and-loop fastener generally referred to as a VELCRO fastener. Draperies to be attached to the curtain rod 10 include preferably mating pieces of VELCRO fastener material. The attachment surfaces of the curtain rod 10 can support a variety of draperies and other window treatments. For example, a first drapery 50 having a mating attachment surface 52 is shown attached to the second attachment surface 22 carried on the inner frame 20 of the curtain rod 10. A second drapery 54 having a mating attachment surface 56 is shown attached to the fourth attachment surface 30 carried on the inner frame 20 of the curtain rod 10.

Figures 2A, 2B, 2C:
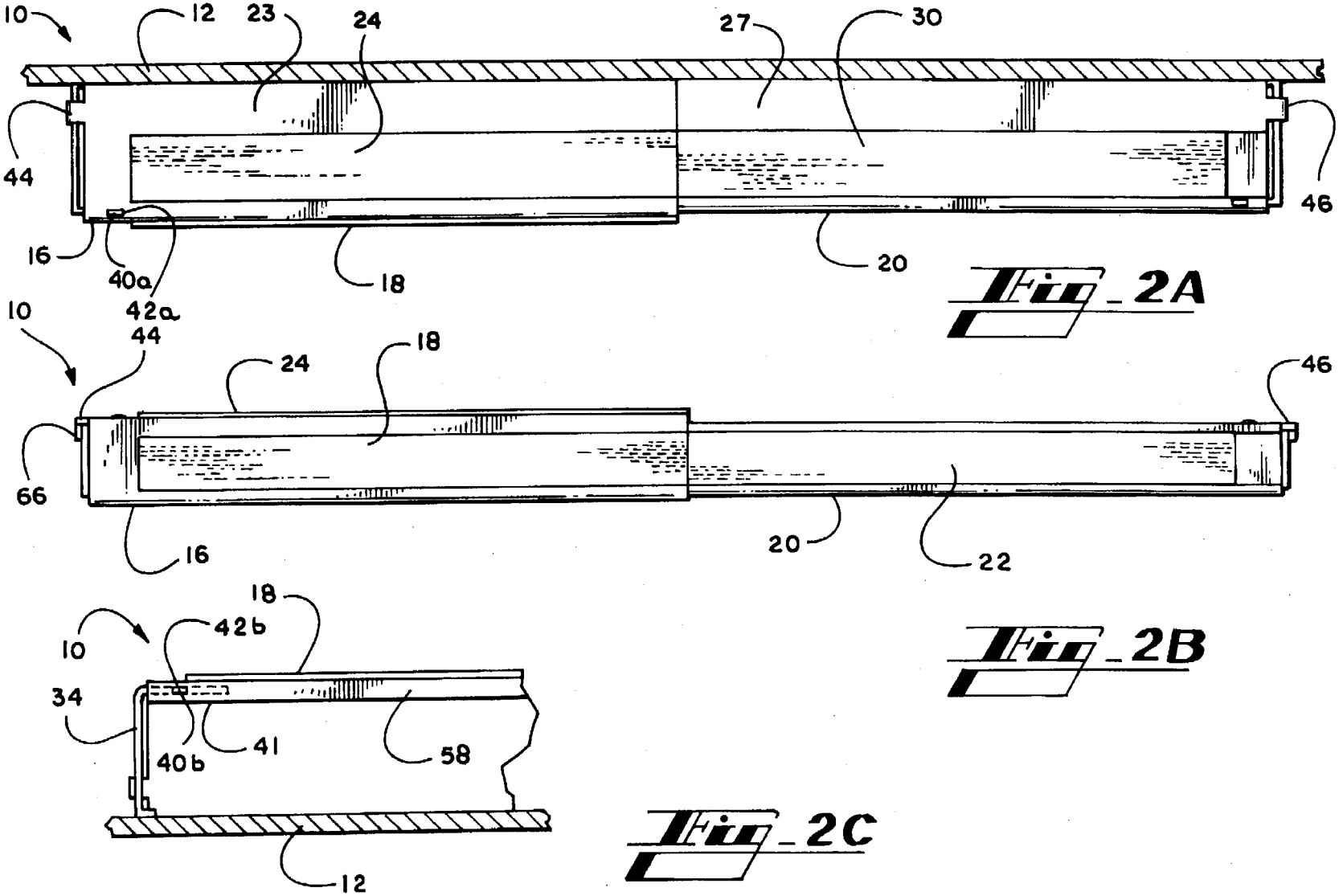
FIG. 2A is a top view.
FIG. 2B is a front view.
FIG. 2C is a partial bottom view, of a telescoping curtain rod with attachment surfaces.

FIG. 2 is a top view, FIG. 2B is a front view, and FIG. 2C is a partial bottom view of the telescoping curtain rod 10 with attachment surfaces. FIG. 2A shows the outer frame 16 and the inner frame 20. The inner frame 20 is slidably mounted within the outer frame 16. The top side 23 of the outer frame 16 carries the third attachment surface 24 and the top side 27 of the inner frame 20 carries the fourth attachment surface 30.

As shown in FIG. 2A, the third attachment surface 24 preferably extends substantially less than the width of the top side 23 of the outer frame 16 and substantially all of the length of the top side 23 of the outer frame 16. In the preferred embodiment, the width of the top side 23 of the outer frame 16 is approximately four inches, whereas the width of the third attachment surface 24 is approximately two inches. The third attachment surface 24 is preferably positioned approximately one-half inch from the front side 17, and one and one-half inches from the rear side 26, of the outer frame 16.

Similarly, the fourth attachment surface 30 preferably extends substantially less than the width of the top side 27 of the inner frame 20 and substantially all of the length of the top side 27 of the inner frame 20. In the preferred embodiment, the width of the top side 27 of the inner frame 20 is approximately four inches, whereas the width of the fourth attachment surface 24 is approximately two inches. The fourth attachment surface 30 is preferably positioned approximately one-half inch from the front side 21, and one and one-half inches from the rear side 28, of the inner frame 20.

As shown in FIG. 2B, the first attachment surface 18 preferably extends substantially less than the height of the front side 17 of the outer frame 16 and substantially all of the length of the front side 17 of the outer frame 16. In the preferred embodiment, the height of the front side 17 of the outer frame 16 is approximately two and one-half inches, whereas the height of the first attachment surface 18 is approximately one and one-half inches. The first attachment surface 18 is preferably positioned approximately one-half inch from the channel 58 (shown in FIG. 3) at the bottom of the front side 17, and one and one-half inches from the top side 23, of the outer frame 16.

Similarly, the second attachment surface 22 preferably extends substantially less than the height of the front side 21 of the inner frame 20 and substantially all of the length of the front side 21 of the inner frame 20. In the preferred embodiment, the height of the front side 21 of the inner frame 20 is approximately two and one-half inches, whereas the height of the second attachment surface 22 is approximately one and one-half inches. The second attachment surface 22 is preferably positioned approximately one-half inch from the channel 64 (shown in FIG. 3) at the bottom of the front side 21, and one and one-half inches from the top side 27, of the inner frame 20.

FIG. 2A shows that the first attachment surface 18 is visible in profile on the outer frame 16, whereas the second attachment surface 22 is not visible in profile on the inner frame 20. This is because the inner frame 20 includes an indentation 60 (shown in FIG. 3) in which the first attachment surface 22 is carded, whereas the outer frame 16 does not include a corresponding indentation.

Similarly, FIG. 2B shows that the third attachment surface 24 is visible in profile on the front view of the curtain rod 10, whereas the fourth attachment surface 30 is not visible in profile. This is because the inner frame 20 includes an indentation 62 (shown in FIG. 3) in which the third attachment surface 30 is carded, whereas the outer frame does not have a corresponding indentation. The attachment surfaces 30 and 22 carded by the inner frame 20 are flush with the non-indented portions of the inner frame 20. The outer frame 16 therefore frictionally engages the inner frame 20, yet allows the inner frame 20 to easily slide within the outer frame 16.

FIG. 2C shows a partial bottom view of the outer frame 16 and the first bracket 34. The lower end of the front side 17 of the outer frame 16 defines a channel 58. The channel 58 preferably includes a hole **42*b* for receiving a projection 40*b* of the spring clip 41 of the first bracket 34. The lower end of the front side 21 of the inner frame 20 defines a channel 64 (shown on FIG. 3C). The channel 64 preferably includes a hole (not shown) similar to the hole 42*b* for receiving a projection of a spring clip (not shown) similar to the projection 40*b* of the spring clip 41**.

Figure 3A:
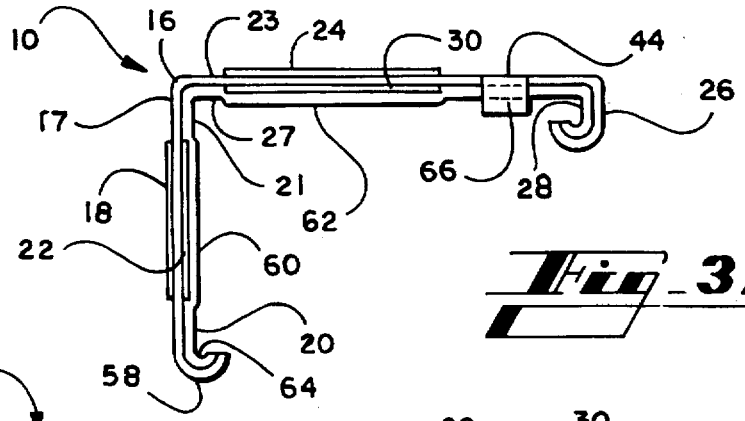
FIG. 3A is a side view of a telescoping curtain rod with attachment surfaces.
Figure 3B:
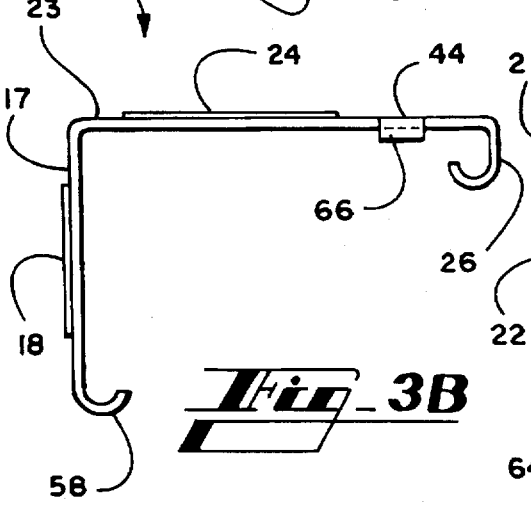
FIGS. 3B and 3C are side views of the outer and inner frames of the curtain rod, respectively.
Figure 3C:
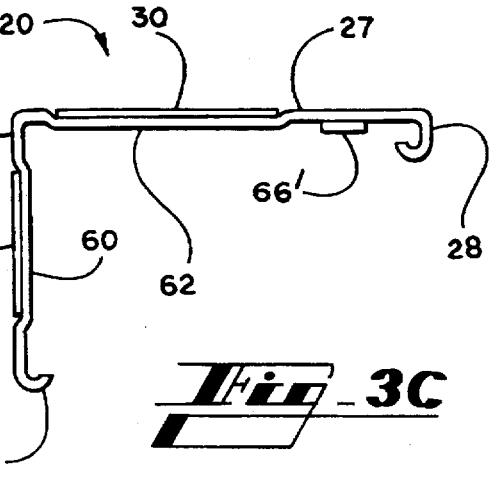

FIG. 3A is a side view of the telescoping curtain rod 10 with attachment surfaces, and FIGS. 3B and 3C are side views of the outer frame 16 and the inner frame 20 of the curtain rod 10, respectively. FIG. 3A shows the outer frame 16 and the inner frame 20 of the curtain rod 10 in slidable engagement. FIG. 3B shows the outer frame 16, and FIG. 3C shows the inner frame 20, individually.

As shown in FIG. 3B, the outer frame 16 has a front side 17 carrying the first attachment surface 18 and a top side 23 carrying the third attachment surface 24. The outer frame 16 also includes a rear side 26 and a first tab defined by the top side 23 of the outer frame. It should be noted that the outer frame 16 does not include indentations for receiving the first attachment surface 18 or the third attachment surface 24. The lower end of the front side 17 of the outer frame 16 defines a channel 58.

As shown in FIG. 3C, the inner frame 20 has a front side 21 carrying the second attachment surface 24 and a top side 23 carrying the fourth attachment surface 30. The front side 21 of the inner frame 20 defines a channel 60 receiving the second attachment surface 24 so that the second attachment surface 24 lies approximately flush with the non-indented portion of the front side 21 of the inner frame 20.

Similarly, the top side 27 of the inner frame 20 includes an indentation 62 for receiving the fourth attachment surface 30 such that the fourth attachment surface 30 is approximately flush with the non-indented portion of the top side 27 of the inner frame 20. The front side 17 of the inner frame 20 defines a channel 64. Referring to FIG. 2C, the channel 64 preferably includes a hole (similar to the hole **42*b*) for receiving a projection (similar to the projection 40*b*) of a spring clip 43 of the second bracket 36 (shown on FIG. 6). The first bracket 34 is preferably interchangeable with the second bracket 36**.

Figure 4:
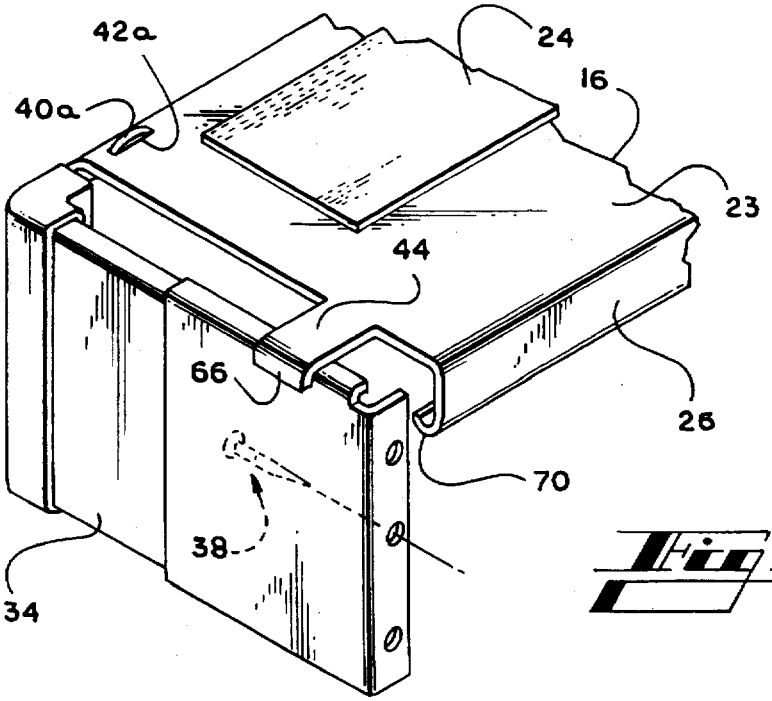
FIG. 4 is a perspective view of the engagement between the bracket and frame of a curtain rod.

FIG. 4 is a perspective view of the engagement between the first bracket 34 and the outer frame 16 of the curtain rod 10. The engagement between the second bracket 36 and the inner frame 20 of the curtain rod 10 is virtually identical, and the brackets 34 and 36 are interchangeable. The first bracket 34 has a spring clip 41 that urges the projection 40*a* of the spring clip 41 through the hole 42*a* defined in the top side 23 of the outer frame 16. An opposing projection 40*b* of the spring clip 41 is similarly urged by the spring clip 41 through an opposing hole 40*b* in the channel 58, as shown on FIG. 2C. The outer frame 16 also includes a rear side 26 that defines a channel 70. The rear side 26 and the channel 70 add rigidity to the inner frame 16.

Still referring to FIG. 4, the tab 44 engages with the bracket 34 so as to support the top side 23 of the outer frame 16 in a position substantially perpendicular to the vertical support surface 12 (shown in FIG. 1). The tab 44 is preferably "L-shaped" with a relatively short foot 66. The tab 46 is also "L-shaped" with a relatively short foot 66' (shown on FIG. 3C). The foot 66 of the tab 44 is relatively short so that it will not prevent the outer frame 16 from slipping laterally into engagement with the bracket 34. Preferably, the foot 66 of the tab 44 is approximately one-eighth to one-quarter of an inch long. The tab 44 may be integral part of the outer frame 16, or it may be a separate component fastened to the outer frame 16 with a screw, rivet, spot weld, or the like.

It will be appreciated that a small amount of flexibility in the nominally perpendicular configuration of the front side 17 and the top side 23 of the outer frame 16 allows the foot 66 of the tab 44 to be lifted over the top of the bracket 34 as the outer frame 16 is slipped laterally into engagement with the bracket 34. The foot 66 of the tab 44 provides the curtain rod 10 with advantageous horizontal stability when draperies are removed from the curtain rod 10 in the familiar tearing motion employed with VELCRO fasteners.

Figure 5:
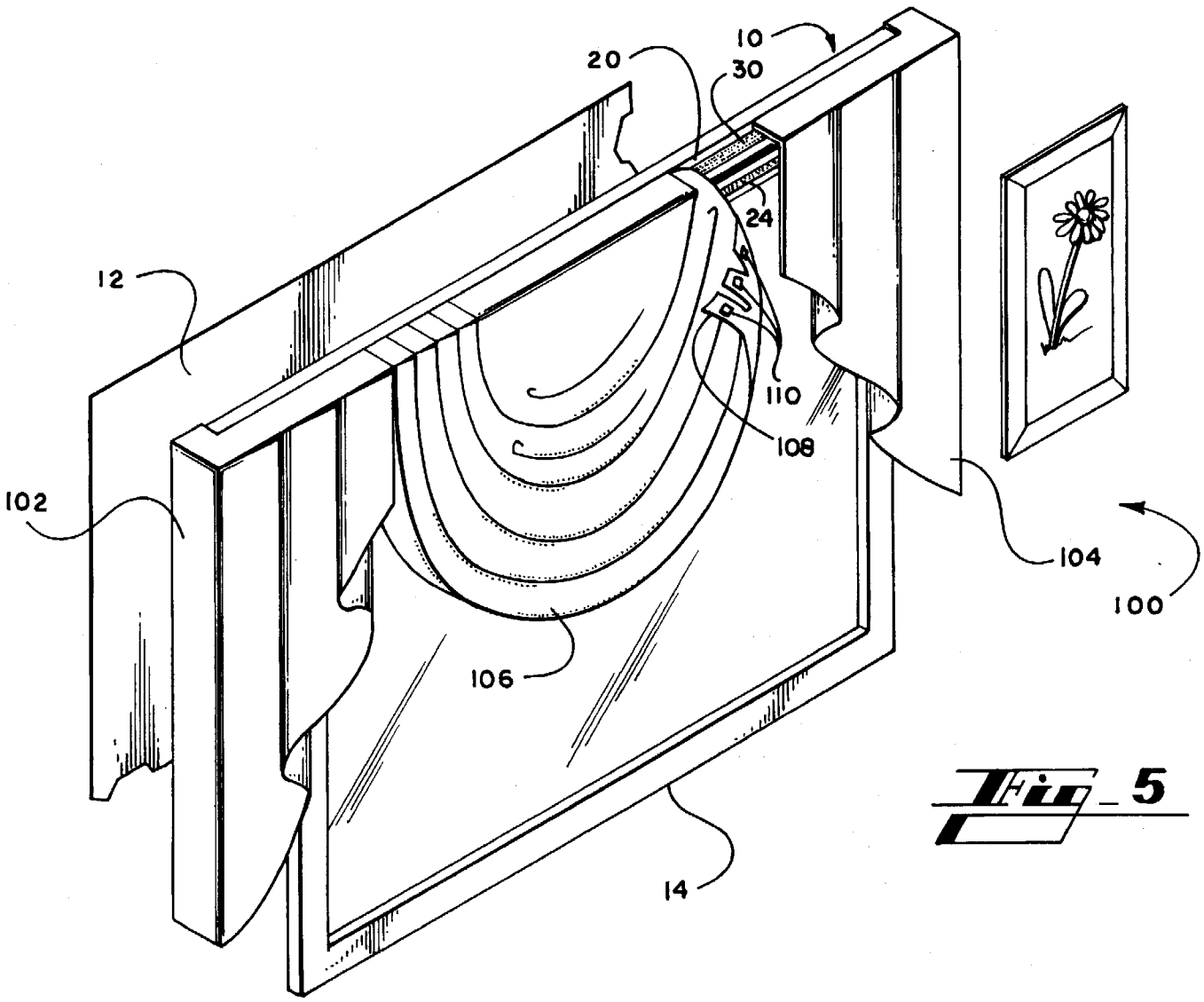
FIG. 5 is a perspective view of an assembled window treatment including a telescoping curtain rod and associated draperies with attachment surfaces.

FIG. 5 is a perspective view of an exemplary assembled window treatment including a telescoping curtain rod 10 constructed in accordance with the preferred embodiment of the present invention. FIG. 5 illustrates one of many different types of window treatments that may be assembled using the inventive curtain rod 10. FIG. 5 is provides an illustration one particular window treatment that may be assembled using the inventive curtain rod 10, and it is not intended to limit the scope of the present invention. Indeed, the versatility of the inventive curtain rod 10 to support a wide variety of different window treatments that can be easily installed and removed is a significant advantage of the present invention.

The illustrative window treatment 100 shown in FIG. 5 includes a left-hand drapery 102, an opposing right-hand drapery 104, and an intermediate swag 106. The draperies 102, 104 and 106 attach to the curtain rod 10 by way of attachment surfaces that mate with the various attachment surfaces of the curtain rod 10. For example, the swag 106 may be constructed according to the teachings of Varney, U.S. Pat. No. 5,094,006, described above. As shown in FIG. 5, a section of the swag 108 is pulled back to expose the mating attachment surface 110.

Figure 6:
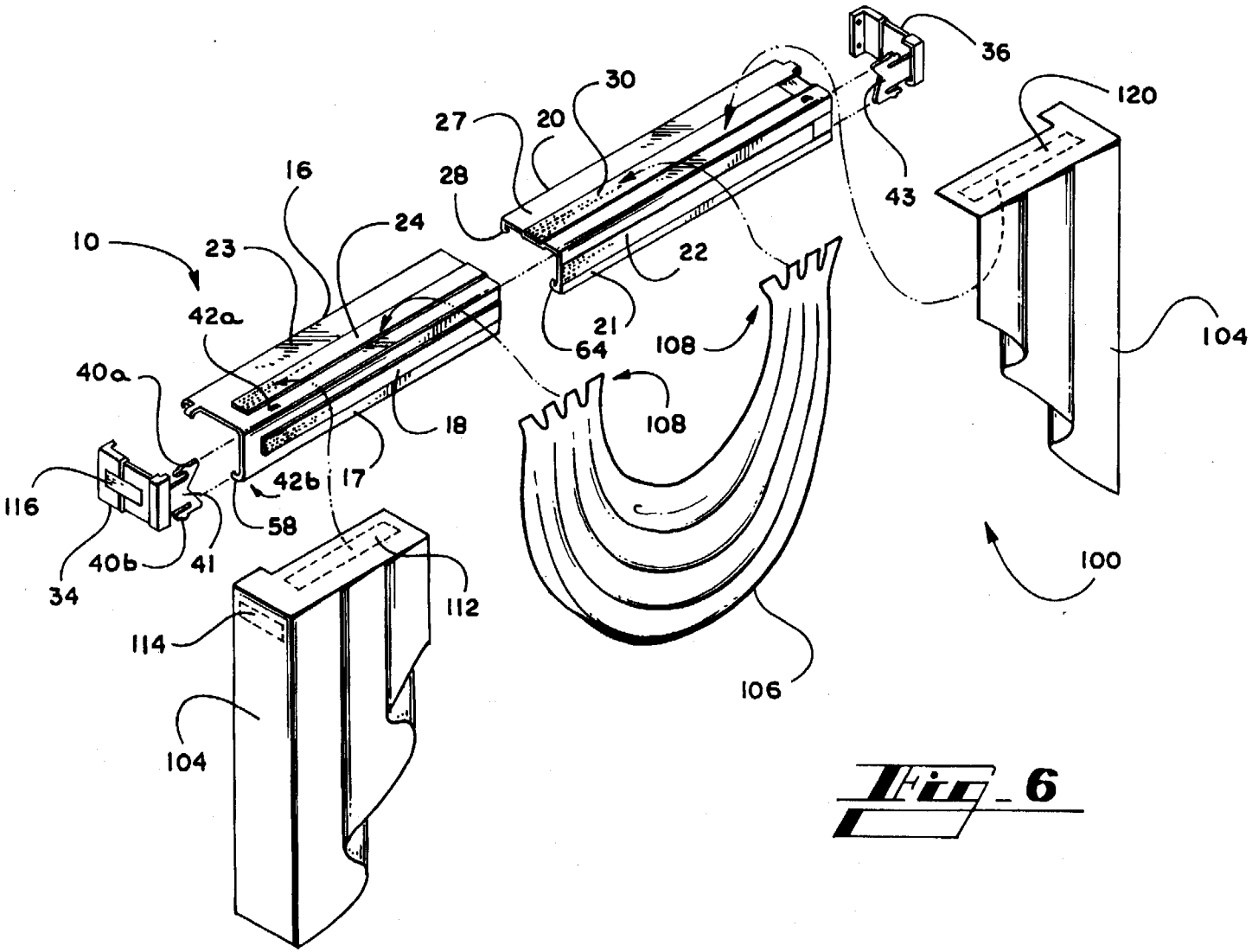
FIG. 6 is an exploded perspective view of an exemplary window treatment including a telescoping curtain rod and associated draperies with attachment surfaces.

FIG. 6 is an exploded perspective view of the exemplary window treatment shown on FIG. 5, including the telescoping curtain rod 10 with attachment surfaces. The left hand drapery 102 attaches to the outer frame 16 by way of a mating attachment surface 112 that attaches to the third attachment surface 24. The left hand drapery also includes a mating attachment surface 114 that attaches to the attachment surface 116 that is carried on the first bracket 34. The attachment surface 116 is preferably an attachment surface such as strip of conventional sticky-back VELCRO material.

Still referring to FIG. 6, the right hand drapery 104 has a mating attachment surface 120 that attaches to the fourth attachment surface 30 carded on the inner frame 20. The right hand drapery 104 also has an attachment surface that attaches to a attachment surface (not shown) carded on the second bracket 36. The swag 106 includes a plurality of tabs indicated generally at 108 that carry attachment surfaces 110 that mate with the third and fourth attachment surfaces 24 and 30.

It will be appreciated that a wide variety of draperies, blinds, awnings and other window treatments may be attached to the inventive curtain rod 10. All such modifications are within the scope and spirit of the present invention. Moreover, it will be appreciated that the specific dimensions of the outer frame 16 and the inner frame 20 may be varied within the scope and spirit of the present invention. It is pointed out that the outer frame 16 and the inner frame 20 are preferably formed of a thin, flat rigid material such as extruded aluminum or other sheet metal formed into the configuration shown in FIG. 1. However, other material such as fiberglass, extruded plastic, or cast material could equivalently be used as the underlying structural component of the outer frame 16 and the inner frame 20.

In view of the foregoing, it will be appreciated that the present invention provides a multi-piece window treatment that can be easily installed and removed. The present invention also provides a curtain rod that supports a multi-piece window treatment that can be easily installed and removed. The present invention also provides window treatments that can be easily adapted to different window locations. The present invention also provides draperies that can be installed without the use of drapery hooks, drapery pockets, or custom made drapery boards. The present invention also provides draperies that can be easily removed for cleaning and redecorating.

It should be understood that the foregoing relates only to specific embodiments of the present invention, and that numerous changes may be made therein without departing from the spirit and scope of the invention as defined by the following claims.

What is claimed is:

1. A curtain rod comprising:

an elongated outer frame having a front side;

a first discrete attachment member affixed to the front side of the outer frame for removably attaching a drapery thereto;

an elongated inner frame slidably mounted within said outer frame, said inner frame having a front side defining an indentation;

a second discrete attachment member affixed within the indentation for removably attaching a drapery thereto, the indentation having a sufficient depth to allow the inner frame, together with the attachment member, to slide within the outer frame.

2. The curtain rod of claim 1, further comprising:

a first bracket attachable to a vertical support surface and attachable to said outer frame; and a second bracket attachable to said vertical support surface and attachable to said inner frame.

3. The curtain rod of claim 1, wherein:

said outer frame comprises means for receiving a first bracket; and said inner frame comprises means for receiving a second bracket.

4. The curtain rod of claim 3, wherein:

said outer frame means for receiving said first wall bracket comprises a hole through said outer frame for receiving a first spring clip connected to said first bracket; and said inner frame means for receiving said second wall bracket comprises a hole through said inner frame for receiving a second spring clip connected to said second bracket.

5. The curtain rod of claim 4, wherein the first and second attachment members each comprise a strip comprising one piece of a two-piece hoop-and-loop fastener.

6. The curtain rod of claim 1, wherein said outer frame further comprises a top side, and said inner frame further comprises a top side defining a second indentation, further comprising:

a third discrete attachment member for removably attaching a drapery thereto attached to the top side of the outer frame; and a fourth discrete attachment member affixed within the second indentation for removably attaching a drapery thereto, the second indentation having a sufficient depth to allow the inner frame, together with the attachment member, to slide within the outer frame.

7. The curtain rod of claim 6, wherein the third and fourth attachment members each comprise a strip comprising one piece of a two-piece hoop-and-loop fastener.

8. The curtain rod of claim 6 wherein:

the top side of said outer frame defines a first tab for engaging said first bracket so as to maintain the top side of said outer frame substantially perpendicular to said vertical support surface; and the top side of said inner frame defines a second tab for engaging said second bracket so as to maintain the top side of said inner frame substantially perpendicular to said vertical support surface.

9. A curtain rod comprising:

an elongated outer frame having a top side;

a first discrete attachment member affixed to the top side of the outer frame for removably attaching a drapery thereto; and an elongated inner frame slidably mounted within said outer frame, said inner frame having a top side defining an indentation;

a second discrete attachment member affixed within the indentation for removably attaching a drapery thereto, the indentation having a sufficient depth to allow the inner frame, together with the attachment member, to slide within the outer frame.

10. The curtain rod of claim 9, further comprising:

a first bracket attachable to a vertical support surface and attachable to said outer frame; and a second bracket attachable to said vertical support surface and attachable to said inner frame.

11. The curtain rod of claim 9, wherein:

said outer frame comprises means for receiving a first bracket; and said inner frame comprises means for receiving a second bracket.

12. The curtain rod of claim 11, wherein:

said outer frame means for receiving said first wall bracket comprises a first hole for receiving a first spring clip connected to said first bracket; and said inner frame means for receiving said second wall bracket comprises a second hole for receiving a second spring clip connected to said second bracket.

13. The curtain rod of claim 12, wherein the first and second attachment member each comprise a strip comprising one piece of a two-piece hoop-and-hoop fastener.

14. The curtain rod of claim 9, wherein:

the top side of said outer frame defines a first tab for engaging said first bracket so as to maintain the top side of said outer frame substantially perpendicular to said vertical support surface; and the top side of said inner frame defines a second tab for engaging said second bracket so as to maintain the top side of said inner frame substantially perpendicular to said vertical support surface.

15. A window treatment comprising:

a curtain rod having an elongated outer frame having a front side;

a first discrete attachment member affixed to the front side of the outer frame for removably attaching a drapery thereto;

an elongated inner frame slidably mounted within said outer frame, said inner frame having a front side defining an indentation;

a second discrete attachment member affixed within the indentation for removably attaching a drapery thereto, the indentation having a sufficient depth to allow the inner frame, together with the attachment member, to slide within the outer frame;

a first drapery removably attached to said first attachment member; and a second drapery removably attached to said second attachment member.

16. The window treatment of claim 15, further comprising means for attaching said curtain rod to a vertical support surface.

17. The window treatment of claim 15, wherein said outer frame further comprises a top side, and said inner frame further comprises a top side defining a second indentation, further comprising:

a third discrete attachment member attached to the top side of the outer frame for removably attaching a drapery thereto; and a fourth discrete attachment member affixed within the second indentation for removably attaching a drapery thereto, the second indentation having a sufficient depth to allow the inner frame, together with the attachment member, to slide within the outer frame.

18. The window treatment of claims 17, further comprising a third drapery removably attached to at least one attachment member.

19. The window treatment of claim 15, wherein:

the top side of said outer frame defines a first tab for engaging said first bracket so as to maintain the top side of said outer frame substantially perpendicular to said vertical support surface; and the top side of said inner frame defines a second tab for engaging said second bracket so as to maintain the top side of said inner frame substantially perpendicular to said vertical support surface.

20. A window treatment comprising:

an elongated outer frame having a top side;

a first discrete attachment member affixed to the front side of the outer frame for removably attaching a drapery thereto; and an elongated inner frame slidably mounted within said outer frame, said inner frame having a top side defining an indentation;

a second discrete attachment member affixed within the indentation for removably attaching a drapery thereto, the indentation having a sufficient depth to allow the inner frame, together with the attachment member, to slide within the outer frame;

a first drapery removably attached to said first attachment member; and a second drapery removably attached to said second attachment member.

21. A curtain rod comprising:

an elongated outer frame formed of a thin, flat, rigid material, said outer frame defining a front side, a top side substantially perpendicular to the front side of said outer frame, the top side of said outer frame defining a first tab, and means for receiving a first bracket;

an elongated inner frame formed of a thin, flat, rigid material, said inner frame slidably mounted within said outer frame, said inner frame defining a front side having a first indentation, and a top side substantially perpendicular to the front side of said inner frame, the top side of said inner frame having a second indentation, the top side of said inner frame defining a second tab, and means for receiving a second bracket;

a first discrete attachment member attached to the front side of the outer frame extending substantially less than the height and substantially all of the length of the front side of the outer frame;

a second discrete attachment member attached to the top side of the outer frame extending substantially less than the height and substantially all of the length of the top side of the outer frame;

a third discrete attachment member extending substantially less than the height and substantially all of the length of the front side of said inner frame, the third attachment member being positioned within the first indentation, the first indentation having a sufficient depth to allow the inner frame, together with the attachment member, to slide within the outer frame; and a fourth discrete attachment member extending substantially less than the height and substantially all of the length of the top side of said inner frame, the fourth attachment member being positioned within the second indentation, the first indentation having a sufficient depth to allow the inner frame, together with the attachment member, to slide within the outer frame.

* * * * *